US009563174B2

(12) United States Patent
Akiyama

(10) Patent No.: US 9,563,174 B2
(45) Date of Patent: Feb. 7, 2017

(54) ELECTRONIC DEVICE, TIME CORRECTION METHOD, AND TIME CORRECTION PROGRAM

(71) Applicant: Seiko Epson Corporation, Tokyo (JP)

(72) Inventor: Toshikazu Akiyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/060,314

(22) Filed: Mar. 3, 2016

(65) Prior Publication Data

US 2016/0266548 A1 Sep. 15, 2016

(30) Foreign Application Priority Data

Mar. 9, 2015 (JP) ..... 2015-046364

(51) Int. Cl.

| | |
|---|---|
| ***G04B 19/22*** | (2006.01) |
| ***G04C 3/14*** | (2006.01) |
| ***G04G 9/00*** | (2006.01) |
| ***G04R 20/00*** | (2013.01) |
| ***G04B 27/00*** | (2006.01) |
| ***G04C 17/00*** | (2006.01) |

(52) U.S. Cl.

CPC ..... *G04B 27/002* (2013.01); *G04B 19/22* (2013.01); *G04C 17/00* (2013.01); *G04G 9/0076* (2013.01); *G04C 3/14* (2013.01); *G04G 9/0064* (2013.01); *G04R 20/00* (2013.01)

(58) Field of Classification Search

CPC ..... G04B 19/22; G04B 27/002; G04C 3/14; G04C 17/00; G04G 9/0064; G04G 9/0076; G04R 20/00

See application file for complete search history.

(56) References Cited

U.S. PATENT DOCUMENTS

| | | | | |
|---|---|---|---|---|
| 5,379,281 A * | 1/1995 | Koch | G04C 3/14 368/223 |
| 6,490,230 B1 * | 12/2002 | Sakuyama | G04C 3/14 368/11 |
| 2003/0151984 A1 | 8/2003 | Speichinger et al. | |
| 2005/0185516 A1 | 8/2005 | Lazaretnik | |
| 2008/0151697 A1 * | 6/2008 | Giauque | G04B 47/065 368/14 |

(Continued)

FOREIGN PATENT DOCUMENTS

| | | |
|---|---|---|
| EP | 2 555 061 A1 | 2/2013 |
| JP | 2000-131469 A | 5/2000 |

(Continued)

*Primary Examiner* — Vit W Miska

(57) ABSTRACT

An electronic device has a first hand that displays a first time; a second hand that displays a second time; an indicator hand; a detection device that outputs a first time selection signal when it detects a first time selection operation of an input device, and outputs a second time selection signal when it detects a second time selection operation of the input device; a mode setter that sets a first time correction mode to correct the first time when the first time selection signal is received, and sets a second time correction mode to correct the second time when the second time selection signal is received; and a display controller that points the indicator hand to a position other than that of the second hand when the first time correction mode is set, and points the indicator hand to the second hand when the second time correction mode is set.

11 Claims, 15 Drawing Sheets

(56) References Cited

U.S. PATENT DOCUMENTS

| | | | | |
|---|---|---|---|---|
| 2011/0280108 | A1 | 11/2011 | Honda | |
| 2012/0201103 | A1 | 8/2012 | Bakker | |
| 2014/0286138 | A1* | 9/2014 | Hasegawa | G04C 3/14<br>368/80 |

FOREIGN PATENT DOCUMENTS

| | | | |
|---|---|---|---|
| JP | 2008-261683 | A | 10/2008 |
| JP | 2009-008504 | A | 1/2009 |
| JP | 2011-237314 | A | 11/2011 |
| JP | 2014-182047 | A | 9/2014 |
| JP | 2014-215147 | A | 11/2014 |
| JP | 2015-055478 | A | 3/2015 |

* cited by examiner

ELECTRONIC DEVICE, TIME CORRECTION METHOD, AND TIME CORRECTION PROGRAM

CROSS-REFERENCE TO RELATED APPLICATION(S)

This application claims priority under 35 U.S.C. §119 on Japanese Patent Application No. 2015-046364, filed Mar. 9, 2015. The content of this priority application is incorporated by reference in its entirety.

BACKGROUND

1. Technical Field

The present invention relates to an electronic device, a time correction method, and a time correction program.

2. Related Art

Electronic timepieces that have two sets of hour, minute, and second hands for displaying two different times are known from the literature. See, for example, JP-A-2009-8504.

The electronic timepiece described in JP-A-2009-8504 has first hands including a first minute hand and a first hour hand disposed to a pivot in the center of the dial, and second hands including a second minute hand and a second hour hand disposed to a pivot located at a position offset toward 6:00 from the center pivot of the dial. When the crown is pulled out to the first stop, this electronic timepiece goes to a first hands correction mode for correcting the positions of the first hands, and goes to a second hands correction mode for correcting the positions of the second hands when the crown is pulled out to the second stop.

However, if the user does not remember the relationship between the stop position of the crown and the time correction mode when pulling the crown out to adjust the first hands or the second hands of the electronic timepiece described in JP-A-2009-8504, determining whether the first hands correction mode or the second hands correction mode is set is not easy. Correcting the desired displayed time is therefore difficult.

SUMMARY

An electronic device, a time correction method, and a time correction program can display multiple times and enable setting the time easily.

An electronic device has: a first hand that displays a first time; a second hand that displays a second time and is disposed to a different position than that of the first hand; an indicator hand disposed to a different position than that of the first hand and second hand; an interface; a detector that outputs a first time selection signal when it detects a first time selection operation of the interface, and outputs a second time selection signal when it detects a second time selection operation of the interface; a mode setter that sets a first time correction mode to correct the first time when the first time selection signal is received, and sets a second time correction mode to correct the second time when the second time selection signal is received; and a display controller that points the indicator hand to a position other than that of the second hand when the first time correction mode is set, and points the indicator hand to the second hand when the second time correction mode is set.

Thus comprised, when the user performs a first time selection operation, the detector outputs a first time selection signal, and the mode setter sets the first time correction mode. The display controller also moves the indicator hand to point to a position other than that of the second hand.

When the user performs the second time selection operation, the detector outputs the second time selection signal, and the mode setter sets the second time correction mode. The display controller also sets the indicator hand to point to the second hand.

Note that the indicator hand pointing (set to) a position other than that of the second hand means that the indicator hand points to a position enabling the user to know from the indicator hand that the second hand are not selected. For example, the indicator hand may point to a different position than that of the rotational range of the second hand or a subdial disposed around the rotational range of the second hand.

That the indicator hand points to (indicates) the second hand means the indicator hand points to a position enabling the user to know from the indicator hand that the second hand are selected. For example, the indicator hand may be set to point to the pivot of the second hand.

Thus comprised, because the indicator hand points to a position other than that of the second hand when the first time correction mode is set, the user can know by looking at the indicator hand that the second time correction mode is not set. More specifically, the user can know that the first time correction mode is set.

Furthermore, because the indicator hand indicates the second hand when the second time correction mode is set, the user can know by looking at the indicator hand that the second time correction mode is set. Adjusting the time is thus simplified.

Preferably in an electronic device according to another aspect, the indicator hand is configured to indicate calendar information corresponding to the first time; and the display controller sets the indicator hand to indicate the calendar information when the first time correction mode is set.

Because the calendar information is indicated by the indicator hand during normal operation, there is no need to provide the electronic device with a separate dedicated hand to display calendar information, and the number of hands on the electronic device can be reduced.

Furthermore, when the first time correction mode is set, the indicator hand continues to display the calendar information for the first time as usual, and it can be easily shown and known that the first time correction mode is set.

An electronic device according to another aspect also has a dial; the pivot of the first hand is disposed to the plane center of the dial, and the pivot of the second hand is offset to a position toward the outside circumference from the plane center of the dial.

Because the first hand are relatively long hand and have their pivot in the plane center of the dial, they move through a larger range of rotation than that of the second hand. It is therefore easier to know what the indicator hand is pointing to when the indicator hand points to the second hand having a smaller range of rotation than if the indicator hand pointed to the first hand having a larger range of rotation.

As a result, whether the first time correction mode or the second time correction mode is set can be more easily determined by the indicator hand pointing to a position other than that of the second hand when the first time correction mode is set and pointing to the second hand when the second time correction mode is set than if the indicator hand points to the first hand when the first time correction mode is set and points to a position other than that of the first hand when the second time correction mode is set.

In an electronic device according to another aspect, the detector outputs the time zone correction signal when it detects the time zone correction operation of the interface; the electronic device further comprising a time zone setter that corrects the time zone data of the first time according to the time zone correction signal when the first time correction mode is set the time zone correction signal is received, and corrects the time zone data of the second time according to the time zone correction signal when the second time correction mode is set and the time zone correction signal is received; and a time corrector that corrects the first time based on the time zone data of the corrected first time, and corrects the second time based on the time zone data of the corrected second time.

Because the user can correct the first time or second time by performing the time zone correction operation, operation is easier than using the interface to manually set the time indicated by the first hand or second hand to the time in the desired location.

An electronic device according to another aspect preferably also has a third hand; the display controller setting the third hand to the time zone data of the first time when the first time correction mode is set, and setting the third hand to the time zone data of the second time when the second time correction mode is set.

The third hand may be a hand disposed to the same position as the first hand, or disposed to a different position than that of the first hand.

Thus comprised, the user can know the time zone of the first time by reading the third hand when the first time correction mode is set, can know the time zone of the second time by reading the third hand when the second time correction mode is set, and can easily know if the time zone data needs correcting.

In an electronic device according to another aspect, the first hand include a first hour hand and a first minute hand; the second hand include a second hour hand and a second minute hand; and when the first time correction mode or the second time correction mode is set, the display controller continues moving the first hour hand, first minute hand, second hour hand, and second minute hand.

Thus comprised, when the first time correction mode or the second time correction mode is set, the user can adjust the first time or the second time while knowing the current time by reading the hand.

In an electronic device according to another aspect, when a previously set indication time has past after setting the indicator hand to the second hand, the display controller points the indicator hand to a position other than that of the second hand.

Thus comprised, when a specific indication time passes after the indicator hand is pointed to the second hand, the daylight saving time setting, for example, can be displayed.

When the user performs the second time selection operation, this aspect enables the user to know that the second time correction mode was set by reading the indicator hand, and can then know the DST setting at the second time by reading the indicator hand when it moves after the specific indication time has past.

Thus comprised, there is no need to provide a separate dedicated hand to display the DST setting, and the number of hands on the electronic device can be reduced.

Operation is also simplified because the user can know the DST setting after the indicator hand points to the second hand without operating the interface.

In an electronic device according to another aspect, the detector outputs a stop indication signal if it detects a stop indication operation of the interface to stop pointing to the second hand with the indicator hand; and the display controller moves the indicator hand to a position other than that of the second hand if the stop indication signal is received while the indicator hand is pointing to the second hand.

When the second time selection operation is performed, the user can know that the second time correction mode was set by looking at the indicator hand, and by then performing the stop indication operation, can know the DST setting, for example, by reading the indicator hand after it has moved.

Thus comprised, there is no need to provide a separate dedicated hand to display the DST setting, and the number of hand on the electronic device can be reduced.

If the user wants to know the DST setting, for example, after the indicator hand points to the second hand, the DST setting can be immediately known by performing the stop indication operation.

In an electronic device according to another aspect, to indicate the second hand with the indicator hand, the display controller points the indicator hand to a specific position in a range where a line extending from the pivot of the indicator hand in the indicated direction intersects a circle drawn by the distal end of the second hand.

That the indicator hand is pointing to the second hand can thus be displayed.

Another aspect is a time correction method of an electronic device, the method comprising: setting a first time correction mode to correct a first time displayed by a first hand of the electronic device when a first time selection signal is received, the first time selection signal being output from a detector of the electronic device when the detector detects a first time selection operation of an interface of the electronic device; setting a second time correction mode to correct a second time displayed by a second hand of the electronic device, the second hand being disposed to a different position than that of the first hand and an indicator hand, when a second time selection signal is received, the second time selection signal being output from the detector when the detector detects a second time selection operation of the interface; and pointing the indicator hand to a position other than the second hand when the first time correction mode is set, and pointing the indicator hand to the second hand when the second time correction mode is set.

The time correction method has the same effect as the electronic device described above.

Another aspect is a time correction program comprising instructions executed by an electronic device, the instructions to cause the electronic device to perform operations comprising: setting a first time correction mode to correct a first time displayed by a first hand of the electronic device when a first time selection signal is received, the first time selection signal being output from a detector of the electronic device when the detector detects a first time selection operation of an interface of the electronic device; setting a second time correction mode to correct a second time displayed by a second hand of the electronic device, the second hand being disposed to a different position than the first hand and an indicator hand, when a second time selection signal is received, the second time selection signal being output from the detector when the detector detects a second time selection operation of the interface; and pointing the indicator hand to a position other than the second hand when the first time correction mode is set, and pointing the indicator hand to the second hand when the second time correction mode is set.

The time correction program has the same effect as the electronic device described above.

Other objects and attainments together with a fuller understanding of the invention will become apparent and appreciated by referring to the following description and claims taken in conjunction with the accompanying drawings.

DESCRIPTION OF EMBODIMENTS

Preferred embodiments are described below with reference to the accompanying figures.

Embodiment 1

Figure 1:
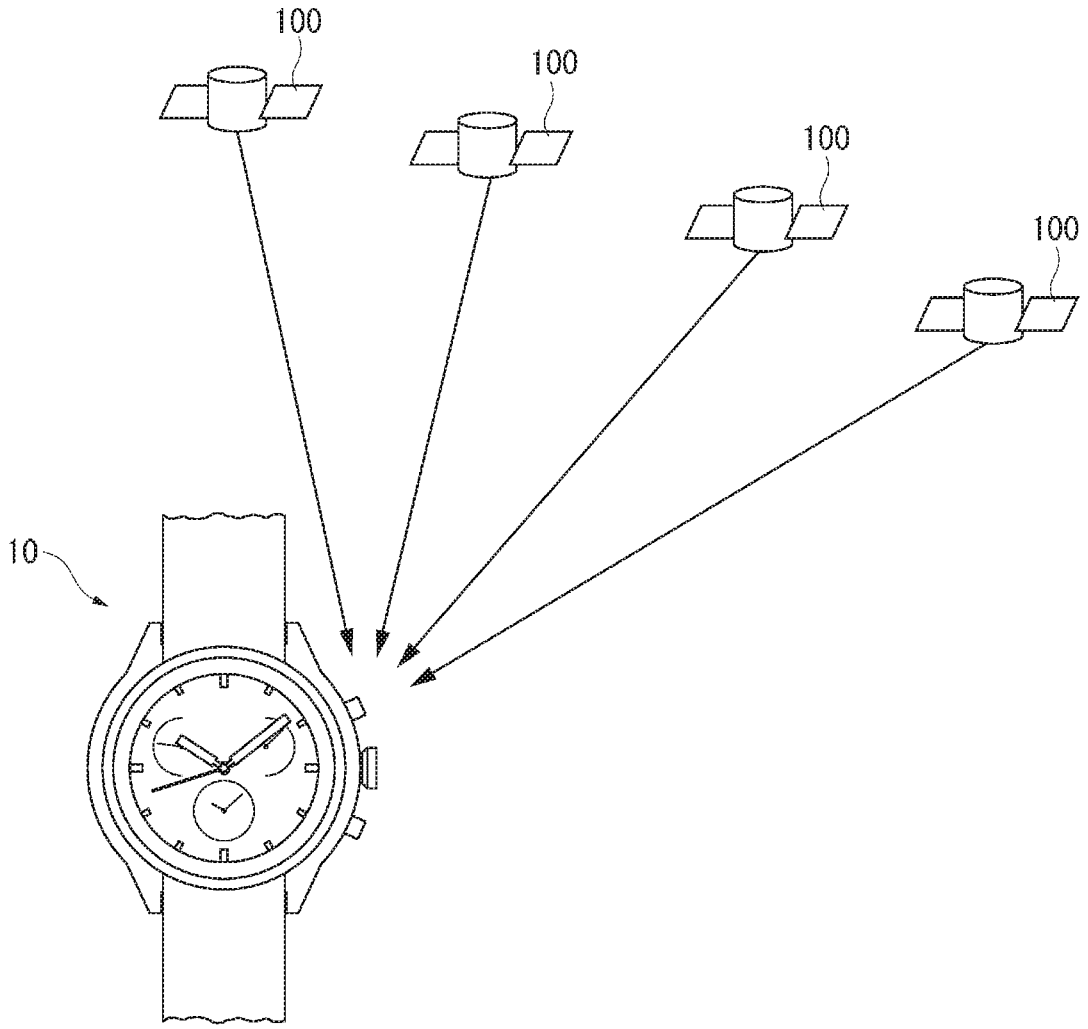
FIG. 1 schematically illustrates use of an electronic timepiece according to a first embodiment.

FIG. 1 illustrates the use of an electronic timepiece 10 according to the first embodiment.

The electronic timepiece 10 described as an example of an electronic device receives satellite signals from at least one of the multiple positioning information satellites 100 orbiting the Earth on known orbits to acquire time information, and receives satellite signals from at least three of the positioning information satellites 100 to calculate positioning information. A GPS satellite 100 is an example of a positioning information satellite, and there are currently approximately 30 GPS satellites 100 in service.

Electronic Timepiece Construction

The electronic timepiece 10 in this embodiment is a timepiece that has a dual time display function for displaying a first time and a second time.

Figure 2:
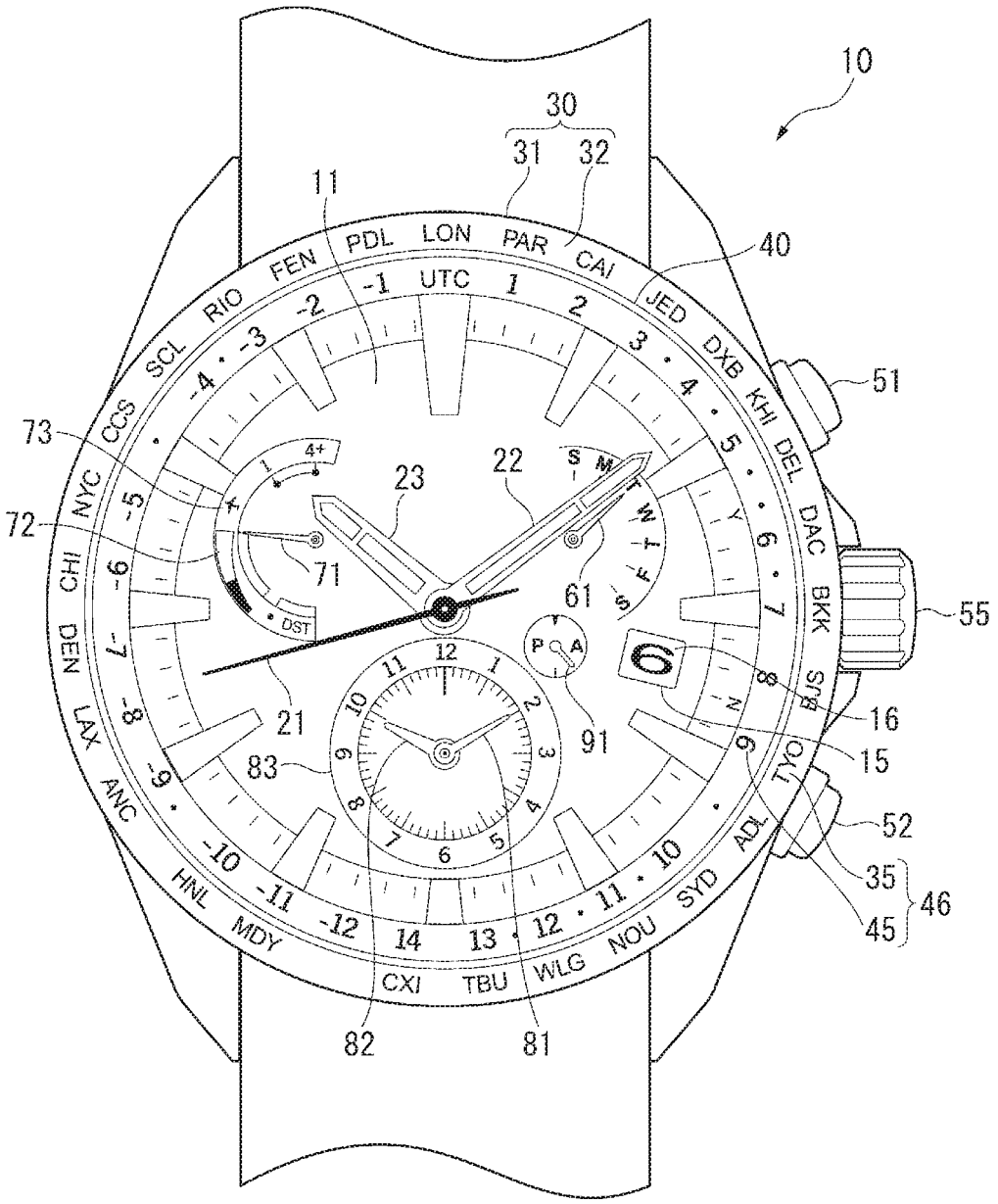
FIG. 2 is a front view of an electronic timepiece according to the first embodiment.
Figure 3:
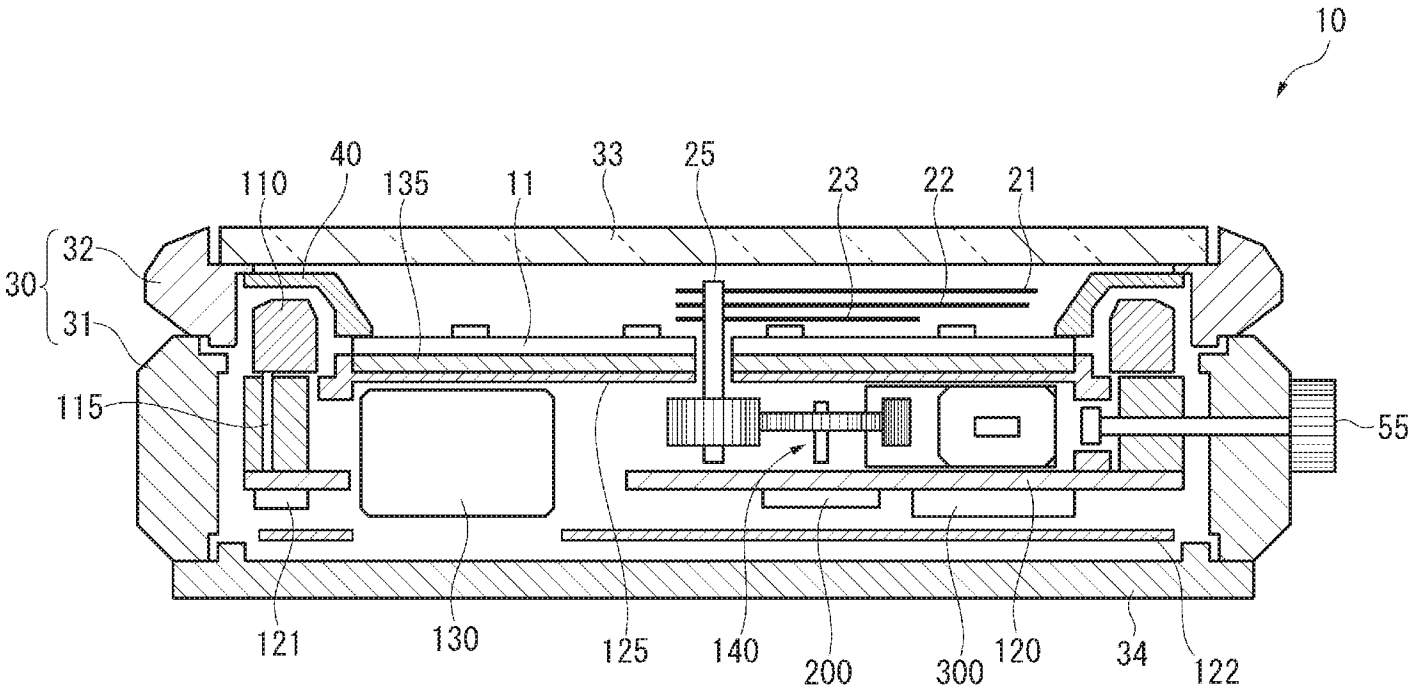
FIG. 3 is a section view of an electronic timepiece according to the first embodiment.

FIG. 2 is a front view of the electronic timepiece 10, and FIG. 3 is a basic section view of the electronic timepiece 10.

As shown in FIG. 2 and FIG. 3, the electronic timepiece 10 has an external case 30, crystal 33, and back cover 34.

The external case 30 includes a ceramic bezel 32 affixed to a cylindrical case member 31 made of metal. A round dial 11 used as the time display is held inside the inside circumference of the bezel 32 by means of a plastic dial ring 40.

Disposed around the center of the dial 11 in the side of the external case 30 are a button A 51 at 2:00, a button B 52 at 4:00, and a crown 55 at 3:00.

As shown in FIG. 3, of the two main openings in the external case 30, the opening on the face side is covered by the crystal 33 held by the bezel 32, and the opening on the back is covered by the metal back cover 34.

Inside the external case 30 are the dial ring 40 attached to the inside circumference of the bezel 32; an optically transparent dial 11; and a drive mechanism 140 that drives each of the hands 21, 22, 23, 61, 71, 81, 82, 91 and the calendar wheel 16.

The dial ring 40 has a flat portion around the outside that contacts the inside circumference surface of the bezel 32 and is parallel to the crystal 33, and a beveled portion that slopes from the inside circumference part of the flat portion down to the dial 11 and contacts the dial 11. The dial ring 40 is shaped like a ring when seen in plan view, and is conically shaped when seen in section. The flat part and beveled part of the dial ring 40, and the inside circumference surface of the bezel 32, create a donut-shaped space inside of which a ring-shaped antenna 110 is housed.

The dial 11 is a round disk for indicating the time inside the external case 30, is made of plastic or other light-transparent material, and is disposed inside of the dial ring 40 with the hands between the dial 11 and the crystal 33.

A solar panel 135, which is a photovoltaic power generator, is disposed between the dial 11 and a main plate 125 to which the drive mechanism 140 is disposed. The solar panel 135 is a round flat panel having plural solar cells (photovoltaic devices) that convert light energy to electrical energy (power) connected in series. Through-holes through which the center arbor 25 of the hands 21, 22, 23, and the pivots (not shown in the figure) of the other hands 61, 71, 81, 82, 91 pass, and an aperture for the calendar window 15, are formed in the dial 11, solar panel 135, and main plate 125.

The drive mechanism 140 is disposed to the main plate 125, and is covered by a circuit board 120 from the back side. The drive mechanism 140 includes a stepper motor and wheel train, and drives the hands by the stepper motor rotationally driving the pivots and such through the wheel train.

The drive mechanism 140 more specifically includes first to sixth drive mechanisms. The first drive mechanism drives the minute hand 22 (minute hand) and hour hand 23 (hour hand); the second drive mechanism drives the second hand 21; the third drive mechanism drives hand 61; the fourth drive mechanism drives hand 71; the fifth drive mechanism drives hands 81, 82, and 91; and the sixth drive mechanism that drives the calendar wheel 16.

The circuit board 120 has a reception device (GPS module) 400, a control device (controller) 300, and a storage device 200. The circuit board 120 and antenna 110 connect through an antenna connection pin 115. A circuit cover 122 covers the reception device 400, control device 300, and storage device 200 from the back cover 34 side of the circuit board 120 to which these parts are disposed. A lithium ion battery or other type of storage battery 130 is disposed between the ground plate 125 and the back cover 34. The storage battery 130 is charged with power produced by the solar panel 135.

Display Mechanism of the Electronic Timepiece

The second hand 21, first minute hand 22, and first hour hand 23 are disposed to a center arbor 25 that passes through the dial in the plane center of the dial 11, and is aligned with the center axis between the front and back of the timepiece. Note that the center pivot 25 comprises three pivots (rotational pivots) to which the hands 21, 22, 23 are attached.

As shown in FIG. 2, a scale of 60 minute markers is formed on the inside circumference side of the dial ring 40 around the outside edge of the dial 11. When normally displaying the time, the second of the first time (local time, such as the current local time when travelling abroad) is indicated by the second hand 21, the minute of the first time is indicated by the minute hand 22, and the hour of the first time is indicated by the hour hand 23 using these markers. Note that because the second of the first time is the same as the second of the second time described below, the user can also know the second of the second time by reading the second hand 21.

Note that the minute hand 22 and hour hand 23 are examples of the first hands. The second hand 21 is an example of the third hand.

Note that an alphabetic Y is disposed at the 12 minute marker on the dial ring 40, and an N is disposed at the 18 minute marker. These letters denote the result of receiving (acquiring) information based on the satellite signals from the GPS satellites 100, Y meaning that reception (acquisition) was successful, and N meaning that reception (acquisition) failed. The second hand 21 points to either Y or N to indicate the result of satellite signal reception.

A hand 61 (day hand) is disposed to a small dial offset from the center of the dial 11 near 2:00. The letters S, M, T, W, T, F, S denoting the seven days of the week are disposed in an arc around the axis of rotation of the hand 61. The hand 61 points to one of the letters S, M, T, W, T, F, S to indicate the day of the week as calendar information for the first time.

The hand 61 is provided to indicate the hands 81, 82 described below. The operation of the hand 61 is described below in detail in the time zone setting process.

This hand 61 is an example of an indicator hand.

Another hand 71 (mode hand) is disposed to a small dial offset from the center of the dial 11 near 10:00. The markers around the outside of the axis of rotation of the hand 71 are described below, but it should be noted that referring to hand 71 pointing in the direction of n:00 (where n is a natural number) below means the position of that time on an imaginary clock dial centered on the pivot of the hand 71.

DST and a black dot are disposed in the area between 6:00 and 7:00 on the imaginary dial around the hand 71. DST denotes daylight saving time. The hand 71 points to either DST or the dot depending on whether or not the electronic timepiece 10 is set to the DST mode (DST meaning the daylight saving time mode is on, and the black dot meaning the DST mode is off).

A sickle-shaped symbol 72 that is wide at the 9:00 end and narrows to the 8:00 end is formed in the area from 8:00 to 9:00 along the outside of the range of hand 71 rotation. This symbol 72 is used as a reserve power indicator for the storage battery 130 (FIG. 3), and the power reserve is indicated by the hand 71 pointing to the position appropriate to the reserve power in the battery. Note that this hand 71 normally points to a position in the symbol 72.

An airplane symbol 73 is provided at 10:00 on the hand 71 dial. This symbol is used to indicate the airplane mode. Receiving satellite signals is prohibited by law when a commercial plane is taking off and landing. By pointing to the airplane symbol 73, the hand 71 indicates the airplane mode is set and satellite signals will not be received.

The number 1 and symbol 4+ are at 11:00 and 12:00 on the imaginary dial of the hand 71. These symbols are used in the satellite signal reception mode. The hand 71 points to 1 when GPS time information is received and the internal time adjusted (in the timekeeping mode), and points to 4+ when receiving GPS time information and orbit information, calculating the positioning information indicating the current location, and correcting the internal time and time zone (in the positioning mode) as described below.

Hand 81 (second minute hand) and hand 82 (second hour hand) are disposed to a small dial offset toward 6:00 from the center of the dial 11. The large hand 81 is the minute hand of the second time (home time, in this example, the time in Japan when travelling in a different country), and the other hand 82 is the hour hand of the second hand.

These hands 81, 82 are examples of the second hands.

A subdial 83 is formed in a ring around the rotational range of the hands 81, 82. The subdial 83 has the numeric markers 1 to 12 representing the hour of the second time.

Hand 91 is disposed to a position offset toward 4:00 from the center of the dial 11, and indicates whether the second time is ante meridiem (a.m.) or post meridiem (p.m.).

The calendar window 15 is a small rectangular opening in the dial 11 through which the date (number) printed on the calendar wheel 16 can be seen. This number denotes the day value of the current date at the first time.

Time difference information 45 indicating the time difference to UTC (Coordinated Universal Time) is denoted by numbers and non-numeric symbols around the inside circumference of the dial ring 40. Numeric time difference information 45 denotes the time difference in integer values, and symbolic time difference information 45 indicates the time difference when the time difference is not an integer value. The time difference between the first time indicated by hands 21, 22, 23 and UTC can be checked in the time correction mode described below by reading the time difference information 45 pointed to by the second hand 21.

City name information 35 is disposed beside the time difference information 45 on the bezel 32 surrounding the dial ring 40. The city name information 35 denotes the name of a city located in the time zone that uses the standard time corresponding to the time difference indicated by the time difference information 45 on the dial ring 40. The markers of the time difference information 45 and the city name information 35 embody a time zone display 46. The time zone display 46 in this embodiment has the same number of time zone markers as there are time zones used in the world today.

Internal Configuration of Electronic Timepiece

Figure 4:
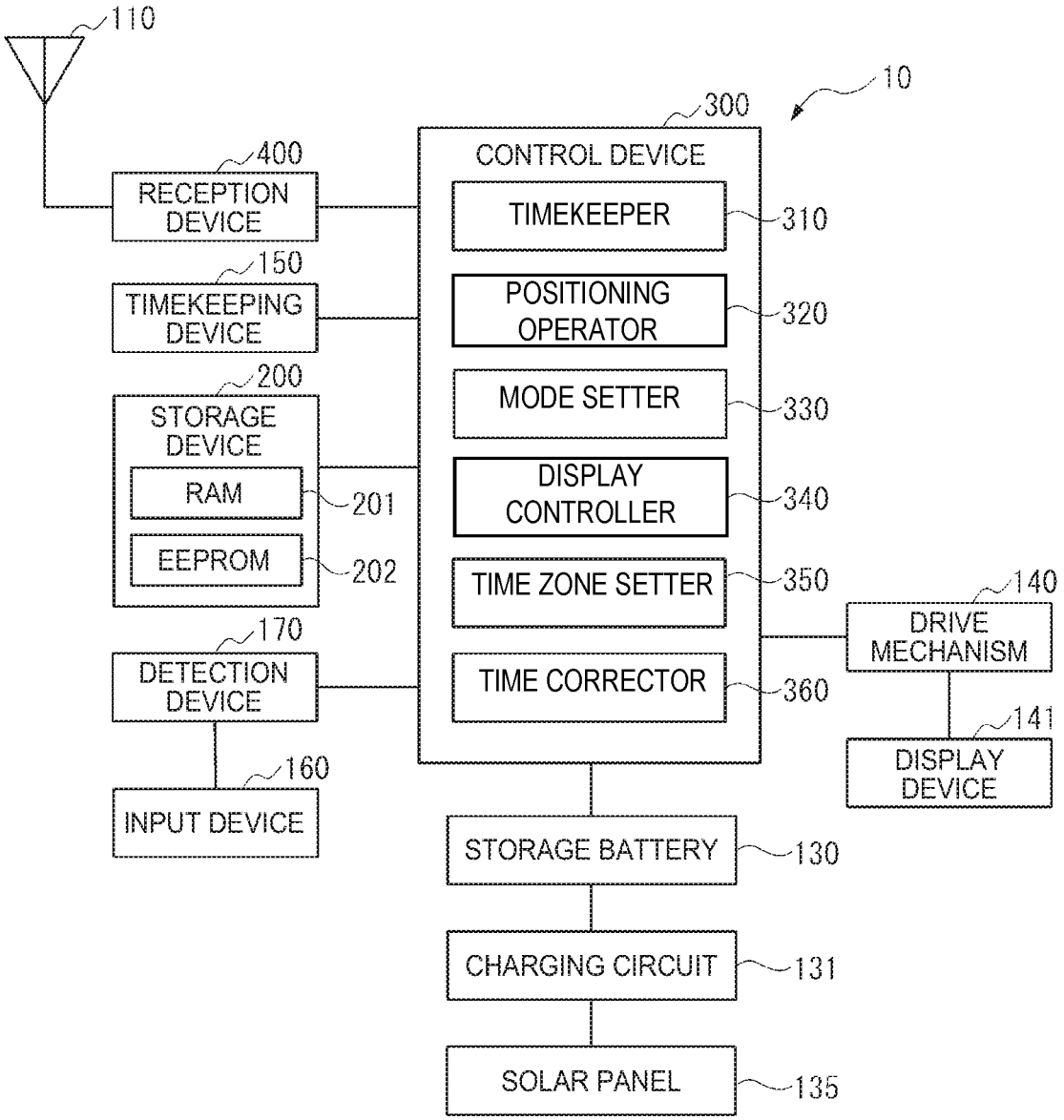
FIG. 4 is a control block diagram of an electronic timepiece according to the first embodiment.

FIG. 4 is a control block diagram of the electronic timepiece 10.

As shown in FIG. 4, the electronic timepiece 10 has a control device 300 comprising a CPU (central processing unit), a storage device 200 including RAM 201 (random access memory) and EEPROM 202 (electronically erasable and programmable read only memory), a reception device 400 (GPS module), a timekeeping device 150, an input device 160, a detection device 170, the drive mechanism 140, and display device 141. These devices communicate with each other over a data bus.

The electronic timepiece 10 has a rechargeable storage battery 130 (see FIG. 3) as the power source. The storage battery 130 is charged by power produced by the solar panel 135 through a charging circuit 131.

Input Device

The input device 160 includes the crown 55, button A 51, and button B 52 shown in FIG. 2. The crown 55 can move to a 0 stop position, first stop position, and second stop position. The crown 55 is normally at the 0 stop (pushed in). The input device 160 is an example of the interface.

Detection Mechanism

The detection device 170 is an example of the detector. The detection device 170 detects user operations instructing executing specific processes based on pushing and releasing the buttons 51, 52 or pulling and pushing the crown 55 out and in, and outputs an operating signal corresponding to the detected operation to the control device 300.

More specifically, the detection device 170 detects a first time selection operation specifying setting the first time correction mode for correcting the first time when the crown 55 moves from the 0 stop or the second stop to the first stop. The detection device 170 also detects the first time selection operation when the second time correction mode is set and the button B 52 is pressed. When the first time selection operation is detected, the detection device 170 outputs a first time selection signal to the control device 300. When the first time selection signal is received to the control device 300, the control device 300 sets the first time correction mode.

The detection device 170 detects a second time selection operation specifying setting the second time correction mode for correcting the second time when the first time correction mode is set and the button B 52 is pushed, and outputs the second time selection signal to the control device 300 when the second time selection operation is detected. When the second time selection signal is received to the control device 300, the control device 300 sets the second time correction mode.

When the first time correction mode or the second time correction mode is set and the crown 55 is turned, the detection device 170 detects a time zone correction operation, and when a time zone correction operation is detected, outputs a time zone correction signal to the control device 300. When the time zone correction signal is received to the control device 300, the control device 300 corrects the time zone data.

When the crown 55 is moved from the first stop to the 0 stop or the second stop, the detection device 170 detects a stop time correction operation instructing stopping the time correction mode, and outputs a stop time correction operation signal to the control device 300 when the stop time correction operation is detected. When the stop time correction operation signal is received to the control device 300, the control device 300 ends the time correction mode.

Display Device

The display device 141 of the electronic timepiece 1 is embodied by the dial 11, subdial 83, dial ring 40, bezel 32, and hands 21, 22, 23, 61, 71, 81, 82, 91 shown in FIG. 2.

Reception Device

The reception device 400 is connected to the antenna 110, processes satellite signals received through the antenna 110, and acquires GPS time information and positioning information. The antenna 110 receives satellite signal waves that are transmitted from the GPS satellites 100 and pass through the crystal 33 and dial ring 40 shown in FIG. 3.

While not shown in the figure, the reception device 400 includes an RF (radio frequency) circuit that receives and converts satellite signals transmitted from the GPS satellites 100 to digital signals; a baseband circuit that executes a reception signal correlation process and demodulates the navigation data message; and a data acquisition circuit that acquires GPS time information and positioning information from the navigation data message (satellite signals) demodulated by the baseband circuit.

Navigation Message (GPS Satellite)

The navigation data message contained in the satellite signals sent from a GPS satellite 100 and carrying the acquired information described above is described next. Note that the navigation message is modulated at 50 bps onto the satellite signal carrier.

Figure 5A:
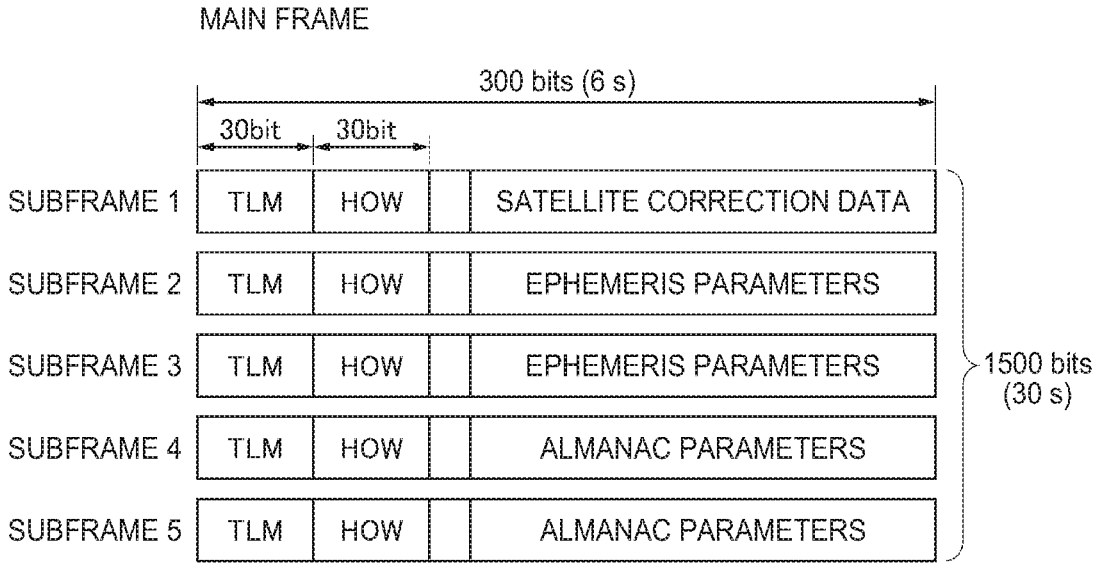
FIGS. 5A, 5B and 5C describe the format of the navigation data message of a GPS satellite signal.
Figure 5B:
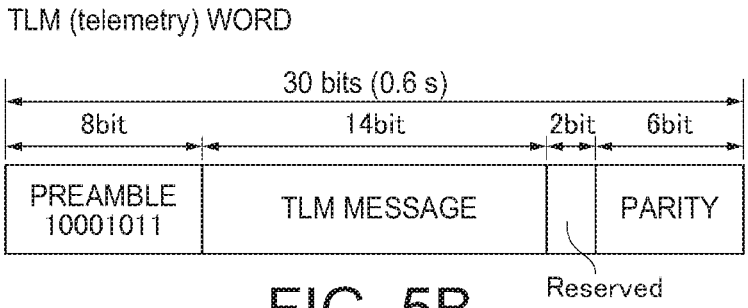
Figure 5C:
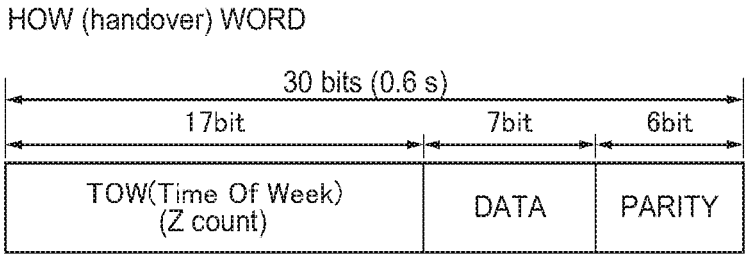

FIG. 5A to FIG. 5C describe the format of the navigation message.

As shown in FIG. 5A, a navigation message is composed of main frames each containing 1500 bits. Each main frame is divided into five subframes 1 to 5 of 300 bits each. The data in one subframe is transmitted in 6 seconds from each GPS satellite 100. It therefore takes 30 seconds for the data in one main frame to be transmitted from a GPS satellite 100.

Subframe 1 contains the week number (WN) and satellite correction data.

The week number identifies the week to which the current GPS time information belongs, and is updated every week.

Subframes 2 and 3 contain ephemeris data (detailed orbit information for each GPS satellite 100). Subframes 4 and 5 contain almanac data (coarse orbit information for all GPS satellites 100).

Each of subframes 1 to 5 starts with a telemetry (TLM) word storing 30 bits of telemetry data followed by a HOW word (handover word) storing 30 bits of handover data.

Therefore, while the TLM and HOW words are transmitted at 6-second intervals from the GPS satellites 100, the week number data and other satellite correction data, ephemeris parameter, and almanac parameter are transmitted at 30-second intervals.

As shown in FIG. 5B, the TLM word contains a preamble, a TLM message and reserved bits, and parity data.

As shown in FIG. 5C, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

The electronic timepiece 10 can therefore acquire date information and time information by retrieving the week number contained in subframe 1 and the HOW word (Z count data) contained in subframes 1 to 5. However, if the week number data was previously received and the time passed from when the week number was acquired is counted internally, the electronic timepiece 10 can know the current week number value of the GPS satellite 100 time without acquiring the week number from a satellite signal again.

The electronic timepiece 10 therefore only needs to acquire the week number value from subframe 1 when week number data (date information) is not already stored internally, such as after a device reset or when the power is first turned on. If the week number is stored, the electronic timepiece 10 can know the current time by simply acquiring the TOW value transmitted every 6 seconds. As a result, the electronic timepiece 10 normally acquires only the TOW as the time information.

Timekeeping Device

The timekeeping device 150 includes a crystal oscillator that is driven by power stored in the storage battery 130, and updates the time data using a reference signal based on the oscillation signal from the crystal oscillator.

Storage Device

Figure 6:
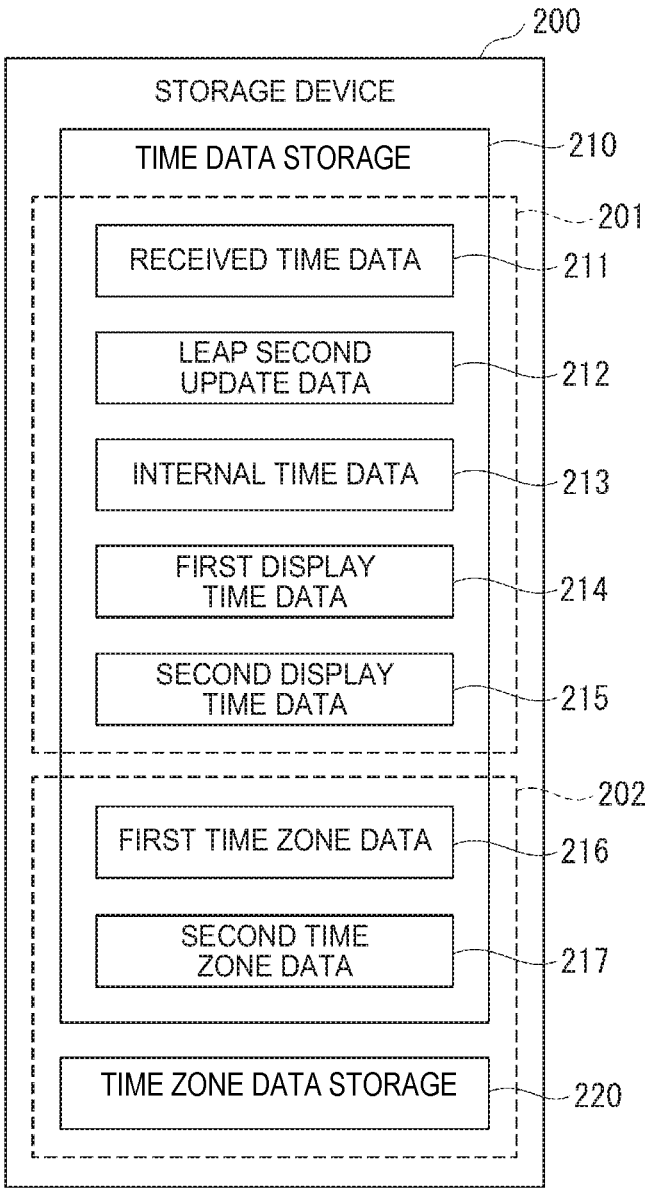
FIG. 6 illustrates the data structure of A storage device in the first embodiment.

The storage device 200, as shown in FIG. 6, includes a time data storage 210 and a time zone data storage 220.

Stored in the time data storage 210 are received time data 211, leap second update data 212, internal time data 213, first display time data 214, second display time data 215, first time zone data 216, and second time zone data 217.

In this embodiment, the received time data 211, leap second update data 212, internal time data 213, first display time data 214, and second display time data 215 are stored in RAM 201; and the first time zone data 216 and second time zone data 217 are stored in EEPROM 202.

The received time data 211 stores the time information (GPS time) acquired from GPS satellite signals. The received time data 211 is normally updated every second by the timekeeping device 150, and when a satellite signal is received, the acquired time information is stored.

The leap second update data 212 stores at least data about the current leap second. More specifically, the current leap second value, the week number of the leap second event, the day number of the leap second event, and the future leap second value, are stored on page 18 in subframe 4 of the GPS satellite signal as data related to the leap second. Of these values, at least the current leap second value is stored in the leap second update data 212.

The internal time data 213 stores internal time information. More specifically, the internal time data 213 is updated based on the GPS time stored in the received time data 211 and the current leap second value stored in the leap second update data 212. As a result, UTC is stored in the internal time data 213. When the received time data 211 is updated by the timekeeping device 150, the internal time data is also updated.

The sum of the internal time stored in the internal time data 213, and the time zone data (time difference information) of the first time zone data 216, is stored in the first display time data 214.

The first time zone data 216 is set to the time zone that is manually selected by the user or is acquired by reception in the navigation mode. The time expressed by the first display time data 214 is the first time that is displayed by the hands 21, 22, 23.

The second display time data 215 is set to the internal time expressed by the internal time data 213 and the time zone set in the second time zone data 217. The second time zone data 217 is the time zone that is manually set by the user. The time expressed by the second display time data 215 is the second time displayed by the hands 81, 82, 91.

Because the first time zone data 216 and second time zone data 217 are stored in EEPROM 202, which is a type of nonvolatile memory, the time zone data stored in the first time zone data 216 and second time zone data 217 remains in memory even if the electronic timepiece 10 shuts down or is reset. When the electronic timepiece 10 boots, the first display time data 214 is initialized to 00:00, and the second display time data 215 is set to the time reflecting the time difference between the time zone data of the first time zone data 216 and the time zone data of the second time zone data 217.

For example, if the first time zone data 216 is set to +9 hours, and the second time zone data 217 is set to +0 hours, the first display time data 214 is initialized to 00:00, and the second display time data 215 is initialized to 15:00, when the system boots.

In another example, if the first time zone data 216 is set to +3 hours, and the second time zone data 217 is set to +6 hours, the first display time data 214 is initialized to 00:00, and the second display time data 215 is initialized to 03:00, when the system boots.

In another example, if the first time zone data 216 is set to +0 hours, and the second time zone data 217 is set to −5 hours, the first display time data 214 is initialized to 00:00, and the second display time data 215 is initialized to 19:00, when the system boots.

Because the time zone data of the first time and second time are not erased and remain in memory even if the electronic timepiece 10 is reset, there is no need to set the time zone data again after the electronic timepiece 10 reboots.

Furthermore, because the first time is initialized to 00:00 when the electronic timepiece 10 boots, the user knows that the time must be set (corrected).

The time zone data storage 220 is stored in EEPROM 202. The time zone data storage 220 relationally stores positioning information (latitude, longitude) and time zone data (time difference information). As a result, when positioning information is acquired in the navigation mode, the control device 300 can acquire the time zone data based on the positioning information (latitude, longitude). While the time zone setting process is described in detail below, note that the control device 300 can also acquire time zone data from the time zone data storage 220 by operation of the crown 55.

Control Device

The control device 300 is embodied by a CPU that controls the electronic timepiece 10.

By running programs stored in the storage device 200, the control device 300 functions as a timekeeper 310, a positioning 320, a mode setter 330, a display controller 340, a time zone setter 350, and a time corrector 360.

The timekeeper 310 operates the reception device 400 to run the reception process in the timekeeping mode. The positioning 320 also operates the reception device 400 to run the reception process in the positioning (navigation) mode.

The mode setter 330 sets the first time correction mode and the second time correction mode.

The display controller 340 controls movement of the hands.

The time zone setter 350 sets the time zone of the first time and the time zone of the second time.

The time corrector 360 corrects the first time and the second time.

The functions of these parts are described below in detail by the processes executed by the control device 300.

Control Process

Figure 7:
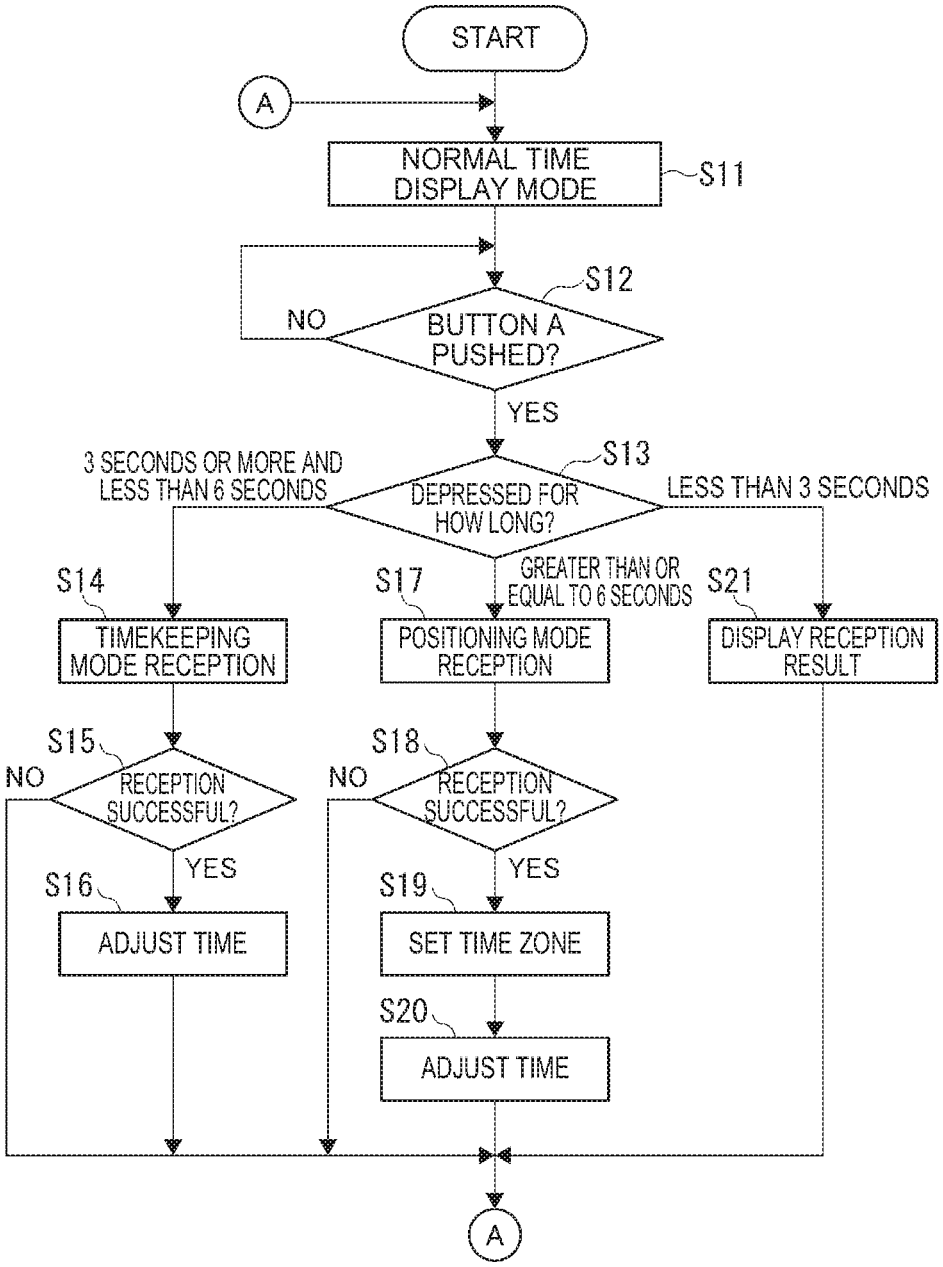
FIG. 7 is a flow chart of the control process in the first embodiment.

The control process executed by the control device 300 when a button is pushed in the normal time display mode is described below. FIG. 7 is a flow chart of the control process executed by the control device 300.

In the normal time display mode (S11), the control device 300 continuously detects if button A 51 was operated based on the operation signal input from the detection device 170 (S12). Note that in the normal time display mode, the crown 55 is at the 0 stop position.

If the control device 300 determines the button A 51 was pressed (S12 returns YES), the device 300 determines how long the button A 51 is continuously pressed (S13).

If the button A 51 is pressed for 3 seconds or more and less than 6 seconds (the operation forcing reception in the timekeeping mode), the timekeeper 310 operates the reception device 400 and runs the reception process in the timekeeping mode (S14). When the reception process runs in the timekeeping mode, the reception device 400 locks onto to at least one GPS satellite 100, receives satellite signals transmitted from that GPS satellite 100, and acquires time information.

Next, the control device 300 determines if acquisition of time information was successful (S15).

If S15 returns YES, the display controller 340 sets the second hand 21 to Y to display that reception was successful.

The time corrector 360 also stores the acquired time information in the received time data 211. As a result, the internal time data 213, first display time data 214, and second display time data 215 are corrected (S16).

If S15 returns NO, the display controller 340 sets the second hand 21 to N to display that reception failed.

After step S16, and if S15 returns NO, the device 300 returns to the normal time display mode in S11, and the display controller 340 sets the second hand 21 to point to the second of the first time.

If the button A 51 is pressed for 6 seconds or more and the operation forcing reception in the navigation mode is performed, the positioning 320 operates the reception device 400 and runs the reception process in the navigation mode (S17). When the reception process runs in the navigation mode, the reception device 400 locks onto to at least three, and preferably four or more, GPS satellites 100, receives satellite signals transmitted from those GPS satellites 100 and acquires positioning information. The reception device 400 simultaneously acquires time information when receiving the satellite signals in this event.

Next, the control device 300 determines if acquisition of the positioning information was successful (S18).

If S18 returns YES, the display controller 340 sets the second hand 21 to point to the Y, indicating that reception was successful.

The time zone setter 350 then sets the time zone data based on the acquired positioning information (latitude, longitude) (S18). More specifically, the time zone setter 350 selects and acquires the time zone data (time zone information, that is, the time difference information) corresponding to the positioning information from the time zone data storage 220, and stores (sets) the time zone data in the first time zone data 216.

For example, because Japan Standard Time (JST) is nine hours ahead of UTC (UTC+9), if the acquired positioning information is a location in Japan, the time zone setter 350 reads the time difference (+9 hours) for JST from the time zone data storage 220, and stores this time difference in the first time zone data 216.

The time corrector 360 then stores the acquired time information in the received time data 211. As a result, the internal time data 213, first display time data 214, and second display time data 215 are corrected.

The time corrector 360 then corrects the first display time data 214 using the first time zone data 216 (S20). As a result, the first display time data 214 is adjusted to the internal time data 213 (UTC) plus the value of the time zone data.

If S18 returns NO, the display controller 340 sets the second hand 21 to N to indicate that reception failed.

After S20, and if S18 returns NO, the control device 300 returns to the normal display mode in S11, and the display controller 340 sets the second hand 21 to the second of the first time.

If button A 51 is pushed for less than 3 seconds and the display reception result operation is performed, the display controller 340 indicates the result of the last reception process by setting the second hand 21 to Y or N (S21). Next, if button B 52 is pushed or a set display time (such as 5 seconds) passes, the control device 300 returns to the normal display mode in S11, and the display controller 340 sets the second hand 21 to the second of the first time.

Time Zone Setting Process

The time zone setting process executed by the control device 300 is described next.

Figure 8:
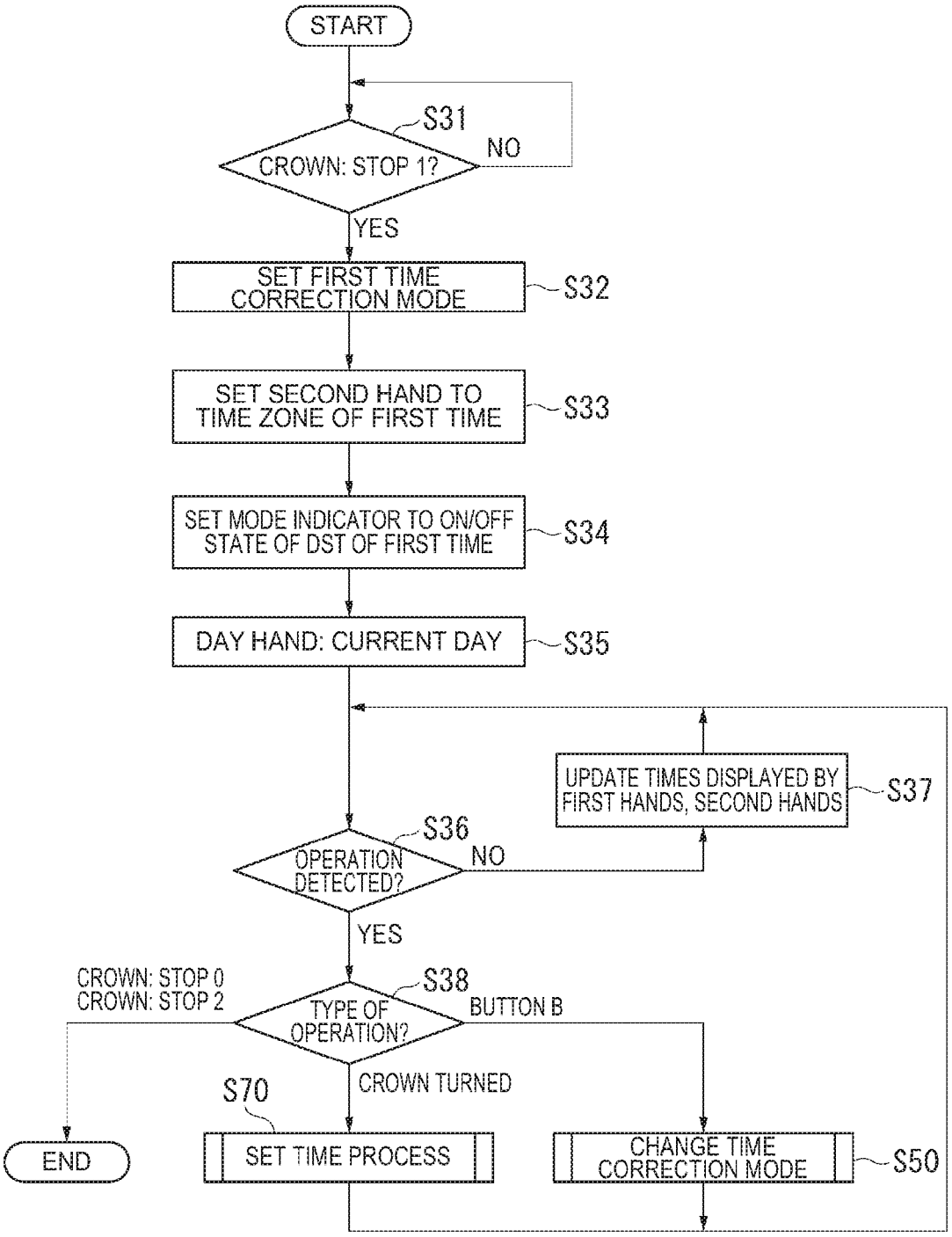
FIG. 8 is a flow chart of the time zone setting process in the first embodiment.

FIG. 8 is a flow chart of the time zone setting process.

Figure 9:
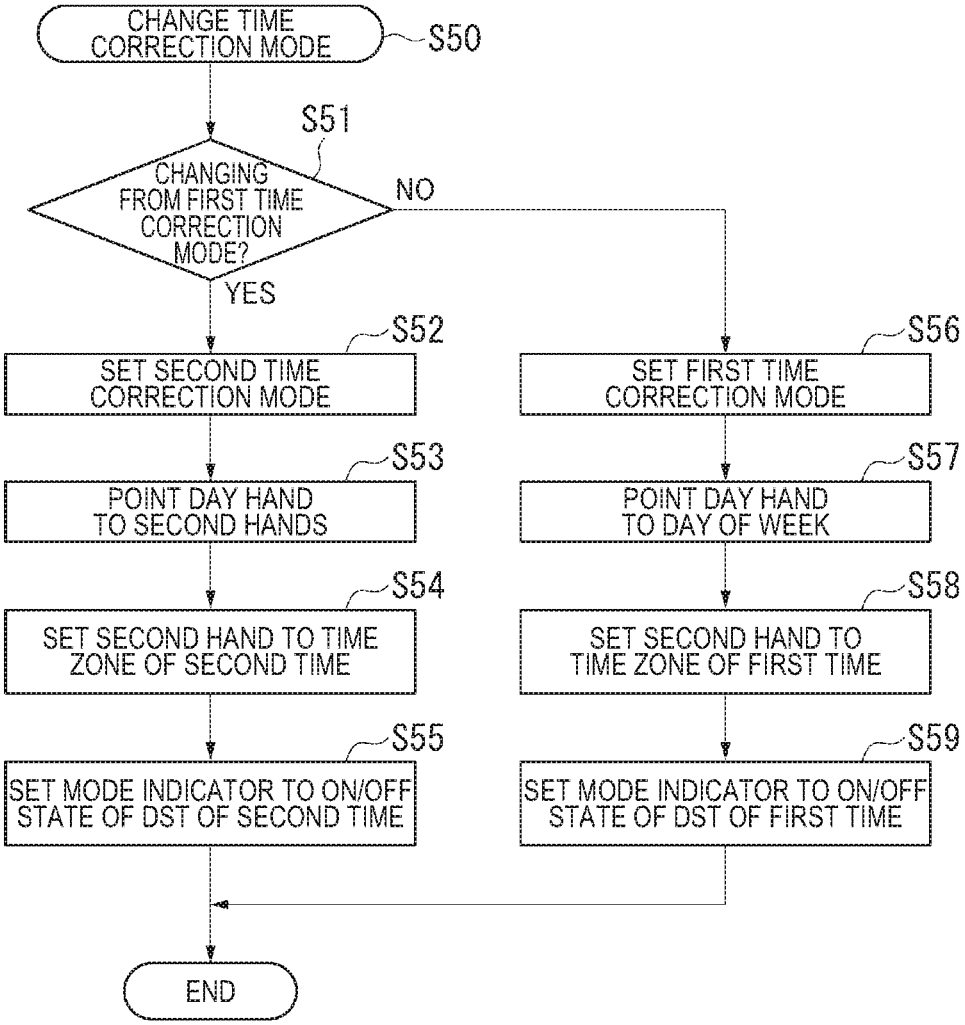
FIG. 9 is a flowchart of the correction mode switching process in the first embodiment.
Figure 10:
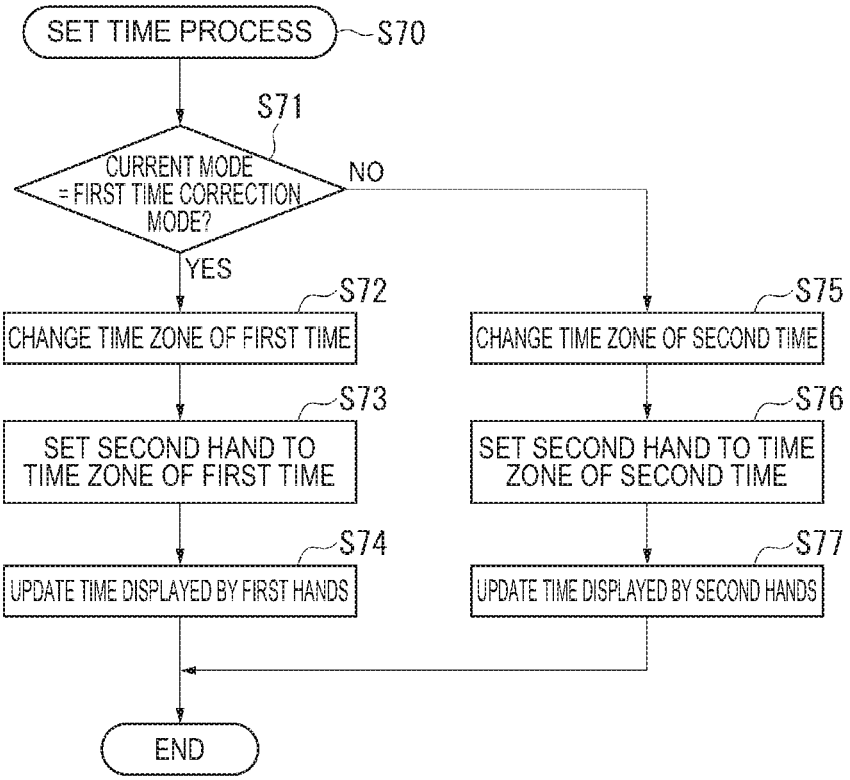
FIG. 10 is a flow chart of the time correction process in the first embodiment.

FIG. 9 is a flow chart of the of the correction mode switching process S50 in the time zone setting process, and FIG. 10 is a flow chart of the time correction process S70 in the time zone setting process.

As shown in FIG. 8, the mode setter 330 determines if the crown 55 was moved to the first stop (S31). If S31 returns NO, the decision step of S31 repeats.

If the crown 55 is moved to the first stop and the first time selection operation is detected, S31 returns YES, and the mode setter 330 sets the first time correction mode (S32).

Figure 11:
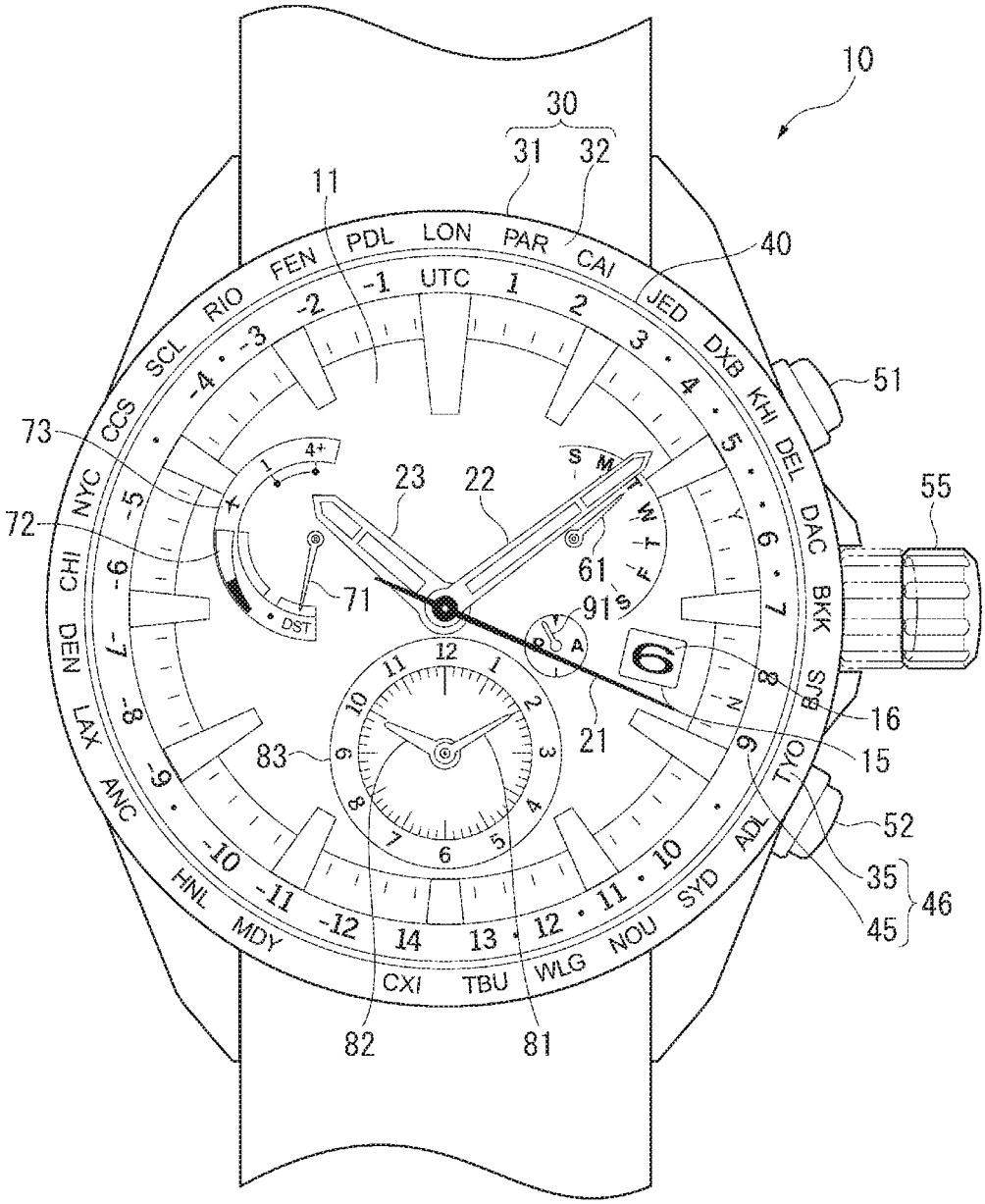
FIG. 11 shows an example of the display in the first time correction mode in the first embodiment.

When the first time correction mode is set, the display controller 340 indicates the time zone data (time zone of the first time) stored in the first time zone data 216 by setting the second hand 21 to the appropriate marker on the time zone display 46 as shown in FIG. 11 (S33).

The display controller 340 as indicates if DST is set for the first time by setting the hand 71 (mode hand) to DST or the black dot (S34).

The display controller 340 also indicates the day of the week at the first time by setting the hand 61 (day hand) to the appropriate marker from S to S (S35).

Next, the control device 300 determines if the input device 160 was operated, that is, if the crown 55 or button B 52 was operated (S36).

If S36 returns NO, the display controller 340 updates the hour and minute of the first time indicated by hands 22, 23, and the hour and minute of the second time indicated by hands 81, 82 (S37). The control device 300 then returns to S36.

If S36 returns YES, the control device 300 determines the type of operation (S38).

If in S38 button B 52 is pushed and the second time selection operation is performed, the control device 300 executes the correction mode switching process S50.

As shown in FIG. 9, when the correction mode switching process S50 executes, the mode setter 330 determines if the mode that was set immediately before the button B 52 was pushed was the first time correction mode (S51). If the first time correction mode was set, S51 returns YES.

If S51 returns YES, the mode setter 330 sets the second time correction mode (S52).

Figure 12:
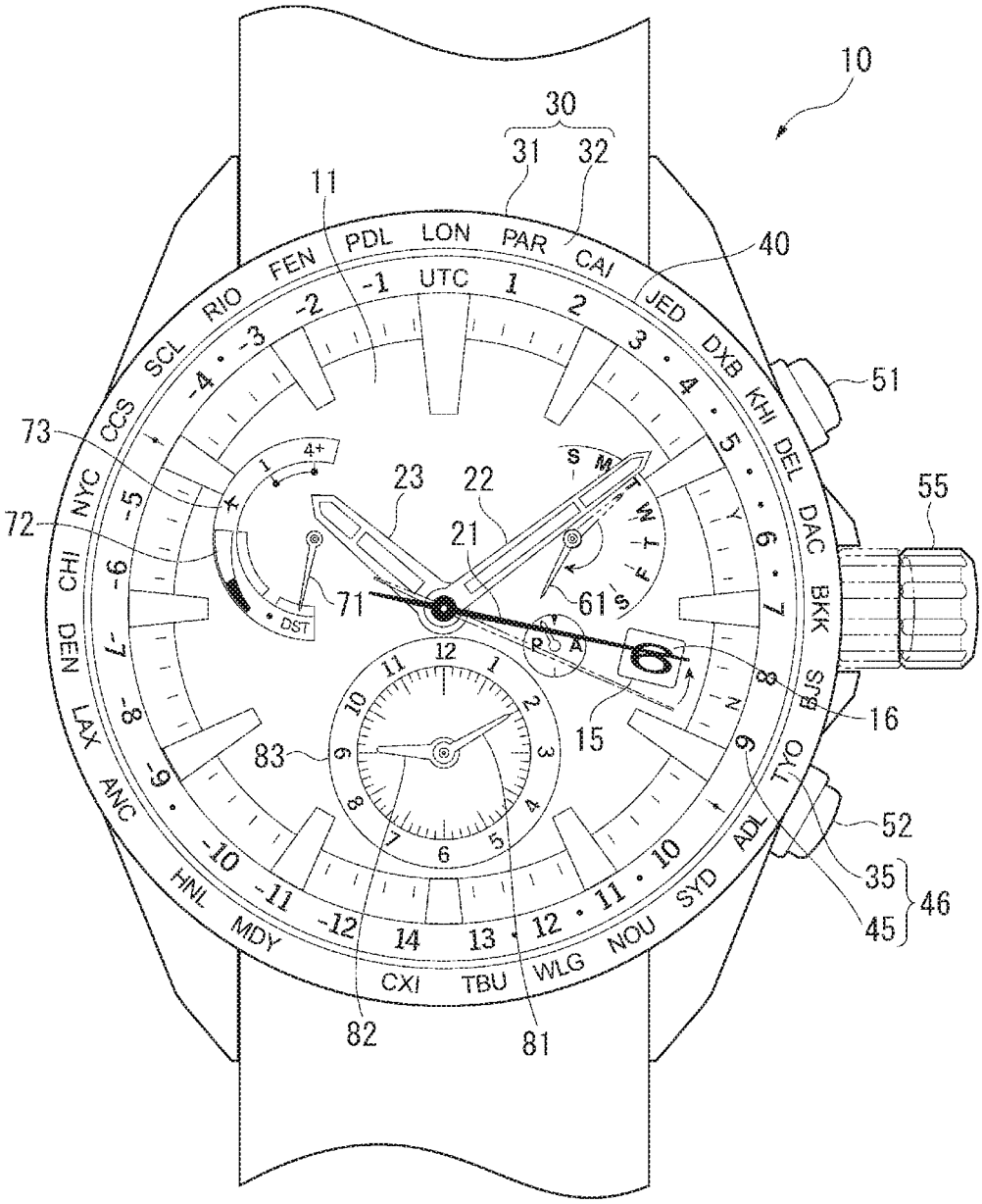
FIG. 12 shows an example of the display in the second time correction mode in the first embodiment.

Next, the display controller 340 moves the hand 61 that was indicating the day to point to the hand 81 (second minute hand) and hand 82 (second hour hand) as shown in FIG. 12 (S53). In this embodiment, the hand 61 points to the pivot of the hands 81, 82 in this event.

The display controller 340 also moves the second hand 21 that was indicating the time zone of the first time to indicate the time zone stored in the second time zone data 217 (that is, the time zone of the second time) (S54).

The display controller 340 also sets the hand 71 to indicate the daylight saving time setting of the second time (S55). The control device 300 then ends the correction mode switching process S50 and returns to S36.

If button B 52 is pushed again, the first time selection operation is detected, and the correction mode switching process S50 is executed, S51 returns NO because the mode set before the first time selection operation was performed is the second time correction mode. In this event, the mode setter 330 sets the first time correction mode (S56).

The display controller 340 then moves the hand 61 that was pointing to the hands 81, 82 to the appropriate marker S to S to indicate the weekday of the first time (S57).

The display controller 340 then sets the second hand 21 to indicate the time zone of the first time (S58).

The display controller 340 also sets the hand 71 to indicate the DST setting of the first time (S59). The control device 300 then ends the correction mode switching process S50, and returns to S36.

The correction mode switching process S50 is thus executed and either steps S52 to S55 or steps S56 to S59 execute each time the button B 52 is pushed.

If in step S38 the crown 55 is turned and the time zone correction operation of turning the crown 55 to advance or reverse the time zone setting a specific time (such as one hour) is performed, the time correction process S70 executes.

As shown in FIG. 10, when the time correction process S70 executes, the control device 300 determines if the currently set mode is the first time correction mode (S71).

If S71 returns YES, the time zone setter 350 adjusts (changes) the time zone setting of the first time according to the time zone correction operation (S72). More specifically, the time zone setter 350 acquires time zone data corresponding to the time zone correction operation from the time zone data storage 220, and stores the acquired time zone data in the first time zone data 216.

Next, the display controller 340 sets the second hand 21 to indicate the time zone setting of the first time zone data 216 (S73).

In addition, the time corrector 360 corrects the first display time data 214 using the time zone data stored in the first time zone data 216. The display controller 340 then updates the hour and minute of the first time indicated by hands 22, 23 (S74). The control device 300 then ends the time correction process S70 and returns to S36.

If S71 returns NO, that is, if the currently set mode is the second time correction mode, the time zone setter 350 corrects (changes) the time zone setting of the second time appropriately to the time zone correction operation (S75). More specifically, the time zone setter 350 acquires the time zone data corresponding to the time zone correction operation from the time zone data storage 220, and stores the acquired time zone data in the second time zone data 217.

Next, the display controller 340 sets the second hand 21 to indicate the time zone set for the second time zone data 217 (S76).

The time corrector 360 also corrects the second display time data 215 using the time zone data stored in the second time zone data 217. The display controller 340 then corrects the hands 81, 82 to indicate the hour and minute of the second time (S77). The control device 300 then ends the time correction process S70 and returns to S36.

The displayed first time or second time is thus adjusted each time the crown 55 is turned to advance or reverse the time zone data a specific time. As a result, the user can reset the time zone data while checking the time reflecting the time zone setting.

If the stop time correction operation is detected in S38 as a result of the crown 55 being pushed from the first stop to the 0 stop or pulled out to the second stop, the control device 300 ends the time zone setting process. As a result, the time zone of the first time or the second time is set. The display controller 340 also indicates the weekday with the hand 61, and moves the second hand 21 to the second of the first time. The control device 300 then starts the time zone setting process again.

If the button A 51 is pushed for 3 seconds or more in the time zone setting process when the first time correction mode is set, the DST setting of the first time switches between ON and OFF. If the second time correction mode is set and the button A 51 is pushed for 3 seconds or more, the DST setting of the second time switches between ON and OFF.

Effect of Embodiment 1

When the crown 55 is moved to the first stop to enter the time correction mode and the first time correction mode is set, the user knows that the second time correction mode is not set by checking the hand 61 because the hand 61 points to a position other than the hands 81, 82. In other words, the user can know that the first time correction mode is set. Because the hand 61 points to the hands 81, 82 when the second time correction mode is set, the user can easily know that the second time correction mode is set by checking the position of the hand 61. The desired time can therefore be easily corrected.

Because the hand 61 indicates the day when in the normal time display mode, there is no need to provide the electronic timepiece 10 with a separate hand to indicate the day, and the number of hands used on the electronic timepiece 10 can be reduced.

Furthermore, because the hand 61 continues to indicate the day of the first time when the first time correction mode is set in the same way as in the normal time display mode, the user can easily know that the first time correction mode is set.

Because hands 22, 23 are relatively long hands with their pivot in the plane center of the dial 11, they move through a larger range of rotation than the hands 81, 82. It is therefore easier to know what the hand 61 is pointing to when the hand 61 points to the hands 81, 82 having a smaller range of rotation than if the hand 61 pointed to the minute hand 22 and hour hand 23 having a large range of rotation.

As a result, whether the first time correction mode or the second time correction mode is set can be more easily determined by the hand 61 pointing to a position other than the hands 81, 82 when the first time correction mode is set and pointing to the hands 81, 82 when the second time correction mode is set than if the hand 61 points to the large minute hand 22 and hour hand 23 when the first time correction mode is set and points to a position other than the hands 22, 23 when the second time correction mode is set.

Because the user can correct the first time or second time by performing the time zone correction operation, operation is easier than using the input device 160 to manually set the time indicated by the hands 22, 23 or hands 81, 82 to the time in the desired location.

The user can also easily know if the time zone must be reset by reading the second hand 21 and getting the time zone setting of the first time when the first time correction mode is set, and reading the second hand 21 and getting the time zone setting of the second time when the second time correction mode is set.

Furthermore, because the second hand 21 is the longest center hand, the time zone is easy to read and display.

The hour and minute of the first time indicated by hands 22, 23, and the hour and minute of the second time indicated by the hands 81, 82, are updated by the time zone setting process in step S37. More specifically, because the hands 22, 23, 81, 82 move continuously even when the first time correction mode or the second time correction mode is set, the user can correct the first time or the second time while knowing the current time by reading the hands.

Embodiment 2

In an electronic timepiece 10A according to the second embodiment, the hand 71 is used to point to the hands 81, 82.

Figure 13:
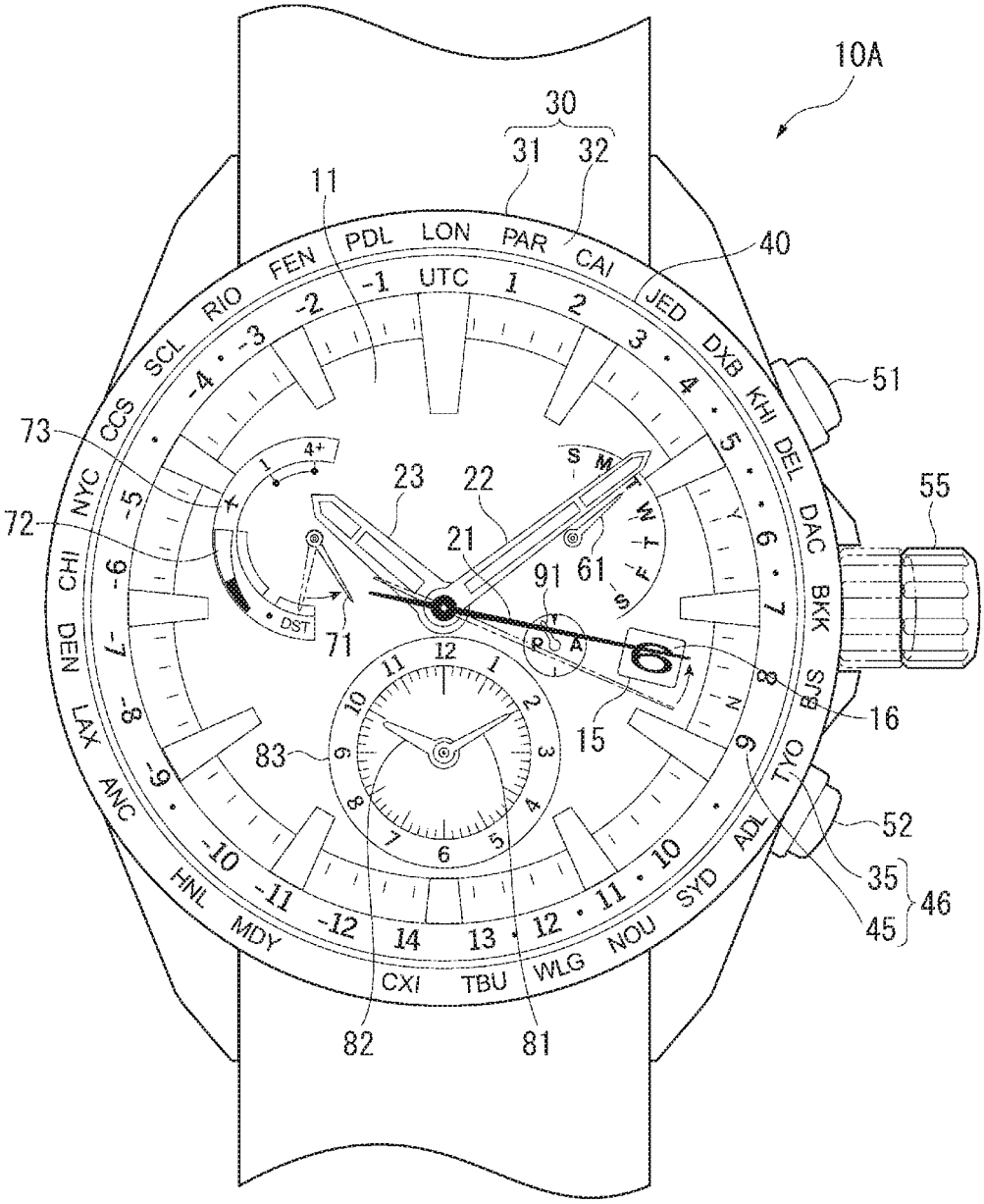
FIG. 13 shows an example of the display in the second time correction mode in the second embodiment.
Figure 14:
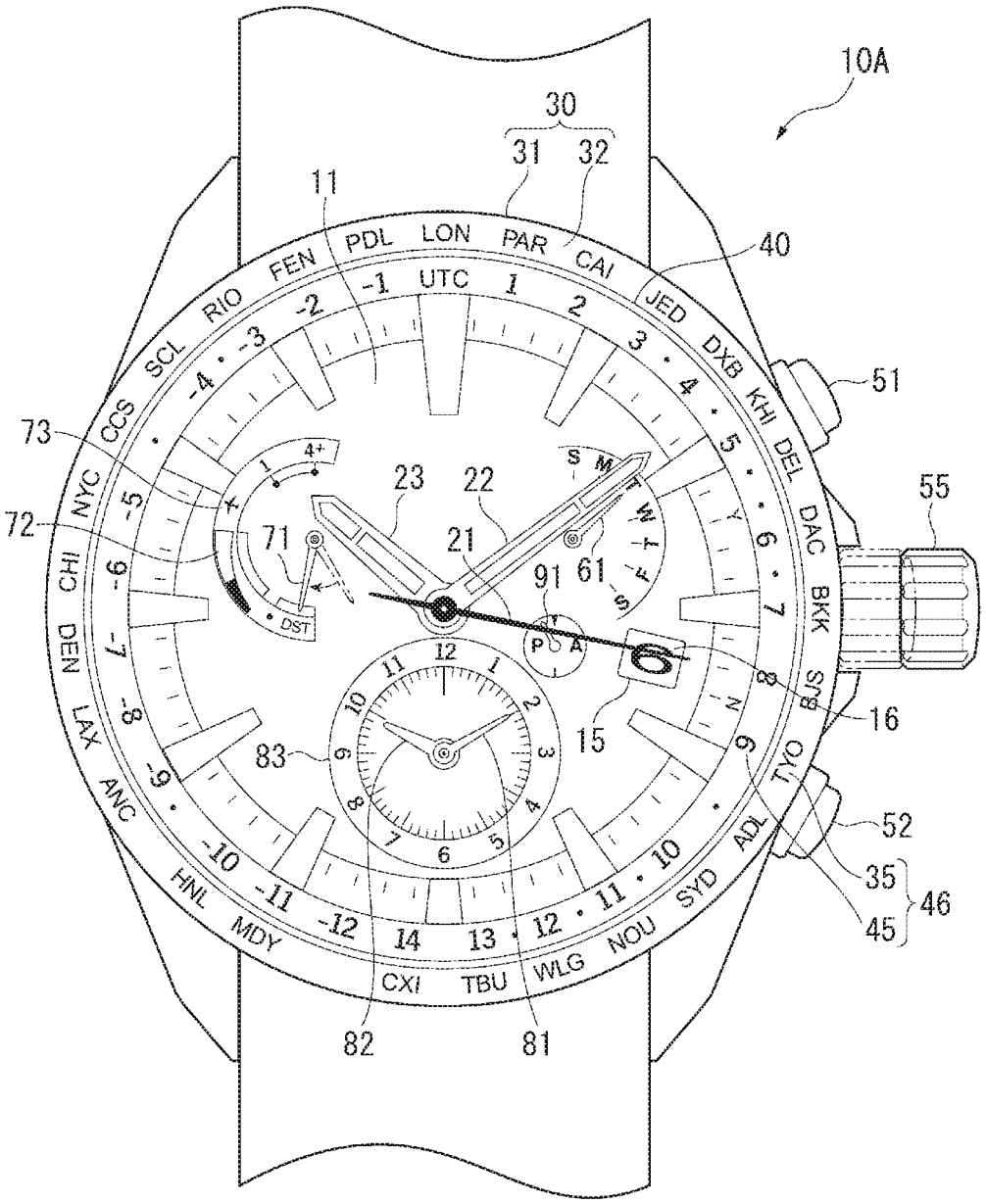
FIG. 14 shows another example of the display in the second time correction mode in the second embodiment.

When the first time correction mode is set, the display controller 340 sets the hand 71 to indicate the DST setting of the first time, and when the second time correction mode is set, sets the hand 71 to point to the pivot of the hands 81, 82 as shown in FIG. 13.

In other words, this hand 71 is an example of an indicator hand.

Note that when the second time correction mode is set in this embodiment, the hand 61 indicates the day of the week.

If the second time correction mode is set and the button A 51 is pushed for less than 3 seconds, the detection device 170 in this electronic timepiece 10A detects a stop indication operation to stop pointing the hand 71 to the hands 81, 82, and outputs a stop indication signal to the control device 300 when the stop indication operation is detected.

If the second time correction mode is set, the hand 71 is pointing to the hands 81, 82, and the stop indication operation is performed, and either the stop indication signal is received from the detection device 170 or a preset time passes (such as 1-2 seconds), the display controller 340 resets the 71 from pointing to the hands 81, 82 to the DST or black dot to show the DST setting of the second time.

Note that the hand 71 may be reset to the DST setting if only the stop indication operation is performed or the specified indication time has past.

Other aspects of the configuration of the electronic timepiece 10A are the same as the electronic timepiece 10 of the first embodiment described above.

Effect of Embodiment 2

The second embodiment has the same effect as the first embodiment. That is, if the first time correction mode is set, the hand 71 points to a different position than the hands 81, 82. The user can therefore know if the first time correction mode is set by reading the hand 71. Furthermore, because the hand 71 points to the hands 81, 82 if the second time correction mode is set, the user can easily know if the second time correction mode is set by reading the hand 71. Setting the time is therefore simple. The second embodiment also has the following effect.

When the user performs the second time selection operation, the user can know by reading the hand 71 that the second time correction mode was set, and can then know the DST setting of the second time by reading the hand 71 after it moves because the indication time has past or the stop indication operation was performed.

As a result, there is no need to provide the electronic timepiece 10A with a separate hand to indicate the daylight saving time setting, and the number of hands used on the electronic timepiece 10A can be reduced.

The user can also know the DST setting without operating the input device 160 if the specified indication time has past after the hand 71 points to the hands 81, 82, and operation is therefore simplified.

If the user wishes to know the DST setting before the specified indication time has past after the hand 71 points to the hands 81, 82, the user can also immediately know the DST setting by performing the stop indication operation.

Other Embodiments

The invention is not limited to the embodiments described above, and can be modified and improved in many ways without departing from the scope of the accompanying claims.

In the first embodiment described above, the hand 61 points to the pivot of the hands 81, 82 when the second time correction mode is set, but the invention is not so limited.

More specifically, the hand 61 may point to any position enabling the user to know that the hands 81, 82 are selected.

Figure 15:
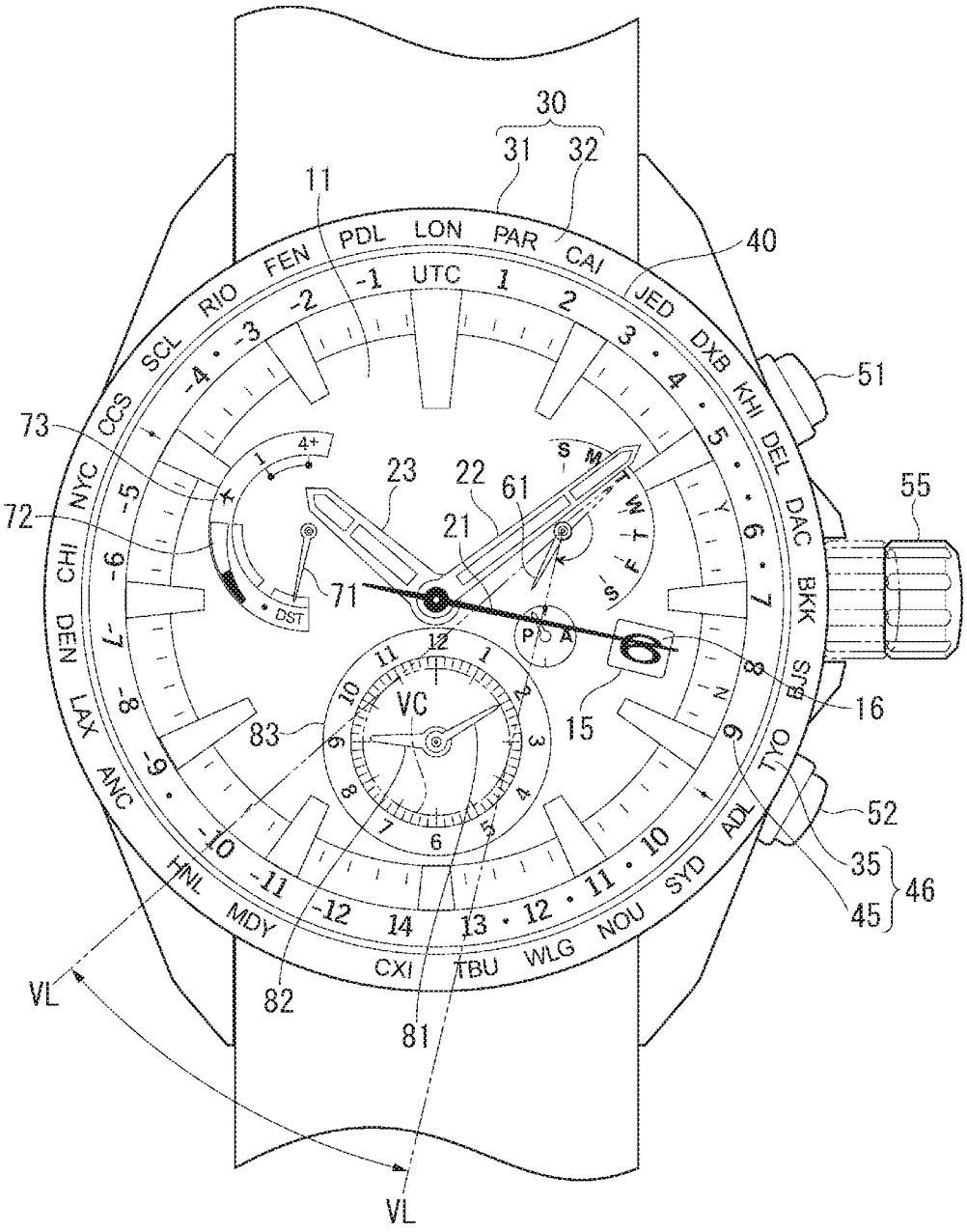
FIG. 15 illustrates an electronic timepiece according to another embodiment.

For example, as shown in FIG. 15, the may point to any specific position in a range where a line VL extending from the pivot of the hand 61 in the direction the hand 61 points intersects the circle VC drawn by the distal end of the hand 81.

The hand 61 may alternatively point to a specific position in the range where the line VL intersects the outside edge of the subdial 83.

The hand 61 can also indicate in this case that the hands 81, 82 are selected.

The hand 71 in the second embodiment can also point in the same direction.

The hand 61 displays the day when the first time correction mode is selected in the first embodiment, but the invention is not so limited.

More specifically, the hand 61 may point to any position enabling the user to know that the hands 81, 82 are not selected.

For example, the hand 61 may point to a different position than the range of hands 81, 82 rotation or the subdial 83.

The hand 61 may further alternatively point to the pivot of the hands 22, 23. Note that if the second time correction mode is selected in this case, the hand 61 may be set to a position other than the hands 81, 82.

This also applies to the direction the hand 71 in the second embodiment points.

The hand 61 may also be configured to indicate the date, month, or year of the first time as the calendar information when the first time correction mode is selected in the first embodiment.

The first time or the second time is corrected by the time zone correction operation in the foregoing embodiments, but the invention is not so limited. For example, the crown 55 may be turned to manually set the time indicated by the hands 22, 23 or hands 81, 82 to the time in a desired location.

When the first time correction mode or the second time correction mode is set in the foregoing embodiments, the second hand 21 indicates the time zone setting, but the invention is not so limited. More specifically, the second hand 21 may continue indicating the second of the first time.

A different hand than the second hand 21 may also be used to indicate the time zone data.

The hands 22, 23 and hands 81, 82 continue moving when the first time correction mode or the second time correction mode is set in the foregoing embodiments, but the invention is not so limited. More specifically, the hands may be stopped.

The hands 21, 22, 23, 61, 71, 81, 82, 91 in the foregoing embodiments may also be images that are displayed by a display such as an LCD panel. However, because the hands 21, 22 or hands 81, 82 that are selected for adjusting can be made to blink in this case, using indicator hands is more useful when the indicator hands are physical members as in the embodiments described above.

The hand 61 or hand 71 used as an indicator hand may further alternatively be hands that are printed on a disk.

The embodiments described above have two sets of hour and minute hands, but the invention is not so limited. More specifically, more than one set of hour and minute hands may be added. In this case, an indicator hand points to the hour and minute hands to be adjusted when the time correction mode is selected for a particular pair of hour and minute hands.

In the embodiments described above, the corresponding daylight saving time setting is not indicated by the hand 71 when the time zone is changed, but the invention is not so limited. More specifically, DST settings and time zone data may be relationally stored in memory, and when the time zone is changed, the corresponding DST setting may be indicated by the hand 71.

In the foregoing embodiments the first time zone data 216 and second time zone data 217 are stored only in EEPROM 202, but the invention is not so limited.

For example, the first time zone data 216 and second time zone data 217 may also be stored in RAM 201 instead of only in EEPROM 202.

In this case, the time zone data is stored in RAM 201 while the time zone is being corrected, the time zone data is then written to EEPROM 202 after the setting the time zone is completed, and EEPROM 202 access can therefore be minimized.

An electronic timepiece according has a time display function, and may be a heart rate monitor that is worn on the user's wrist to measure the heart rate, or a GPS logger that is worn on the user's arm to measure and store current position information while the user is jogging, for example.

The electronic device of the invention is not limited to wristwatches (electronic timepieces), and can be used in a broad range of devices such as cell phones, mobile GPS receivers used when mountain climbing, and a wide range of other battery-powered devices that receive satellite signals transmitted from positioning information satellites.

The foregoing embodiments are described with reference to a GPS satellite 100 as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic device comprising:

a first hand that displays a first time;

a second hand that displays a second time and is disposed to a different position than that of the first hand;

an indicator hand disposed to a different position than that of the first hand and second hand;

an interface;

a detector that outputs a first time selection signal when it detects a first time selection operation of the interface, and outputs a second time selection signal when it detects a second time selection operation of the interface;

a mode setter that sets a first time correction mode to correct the first time when the first time selection signal is received, and sets a second time correction mode to correct the second time when the second time selection signal is received; and a display controller that points the indicator hand to a position other than that of the second hand when the first time correction mode is set, and points the indicator hand to the second hand when the second time correction mode is set.

2. The electronic device described in claim 1, wherein:

the indicator hand is configured to indicate calendar information corresponding to the first time; and the display controller sets the indicator hand to indicate the calendar information when the first time correction mode is set.

3. The electronic device described in claim 1, further comprising:

a dial;

the pivot of the first hand being disposed to the plane center of the dial, and the pivot of the second hand being offset to a position toward the outside circumference from the plane center of the dial.

4. The electronic device described in claim 1, wherein:

the detector outputs the time zone correction signal when it detects the time zone correction operation of the interface;

the controller further including a time zone setter that corrects the time zone data of the first time according to the time zone correction signal when the first time correction mode is set the time zone correction signal is received, and corrects the time zone data of the second time according to the time zone correction signal when the second time correction mode is set and the time zone correction signal is received; and a time corrector that corrects the first time based on the time zone data of the corrected first time, and corrects the second time based on the time zone data of the corrected second time.

5. The electronic device described in claim 4, further comprising:

a third hand;

the display controller setting the third hand to the time zone data of the first time when the first time correction mode is set, and setting the third hand to the time zone data of the second time when the second time correction mode is set.

6. The electronic device described in claim 1, wherein:

the first hand includes a first hour hand and a first minute hand;

the second hand includes a second hour hand and a second minute hand; and when the first time correction mode or the second time correction mode is set, the display controller continues moving the first hour hand, first minute hand, second hour hand, and second minute hand.

7. The electronic device described in claim 1, wherein:

when a previously set indication time has past after pointing the indicator hand to the second hand, the display controller points the indicator hand to a position other than that of the second hand.

8. The electronic device described in claim 1, wherein:

the detector outputs a stop indication signal if it detects a stop indication operation of the interface to stop pointing to the second hand with the indicator hand; and the display controller moves the indicator hand to a position other than that of the second hand if the stop indication signal is received while the indicator hand is pointing to the second hand.

9. The electronic device described in claim 1, wherein:

to indicate the second hand with the indicator hand, the display controller points the indicator hand to a specific position in a range where a line extending from the pivot of the indicator hand in the indicated direction intersects a circle drawn by the distal end of the second hand.

10. A time correction method of an electronic device, the method comprising:

setting a first time correction mode to correct a first time displayed by a first hand of the electronic device when a first time selection signal is received, the first time selection signal being output from a detector of the electronic device when the detector detects a first time selection operation of an interface of the electronic device;

setting a second time correction mode to correct a second time displayed by a second hand of the electronic device, the second hand being disposed to a different position than that of the first hand and an indicator hand, when a second time selection signal is received, the second time selection signal being output from the detector when the detector detects a second time selection operation of the interface; and pointing the indicator hand to a position other than that of the second hand when the first time correction mode is set, and pointing the indicator hand to the second hand when the second time correction mode is set.

11. A device-readable medium containing a time correction program comprising instructions to be executed by an electronic device, the instructions to cause the electronic device to perform operations comprising:

setting a first time correction mode to correct a first time displayed by a first hand of the electronic device when a first time selection signal is received, the first time selection signal being output from a detector of the electronic device when the detector detects a first time selection operation of an interface of the electronic device;

setting a second time correction mode to correct a second time displayed by a second hand of the electronic device, the second hand being disposed to a different position than the first hand and an indicator hand, when a second time selection signal is received, the second time selection signal being output from the detector when the detector detects a second time selection operation of the interface; and pointing the indicator hand to a position other than that of the second hand when the first time correction mode is set, and pointing the indicator hand to the second hand when the second time correction mode is set.

* * * * *